United States Patent [19]

Beer et al.

[11] Patent Number: 4,543,174

[45] Date of Patent: Sep. 24, 1985

[54] METHOD OF MAKING A CATALYTIC LEAD-BASED OXYGEN EVOLVING ANODE

[75] Inventors: Henri B. Beer, Heide Kalmthout, Belgium; Michael Katz, Haifa, Israel; Jean M. Hinden, Chambesy, Switzerland

[73] Assignee: ELTECH Systems Corporation, Boca Raton, Fla.

[21] Appl. No.: 628,533

[22] Filed: Jul. 6, 1984

Related U.S. Application Data

[63] Continuation-in-part of Ser. No. 467,158, Feb. 16, 1983, abandoned.

[51] Int. Cl.[4] ..... C25B 11/00; C25C 7/00

[52] U.S. Cl. ..... 204/290 R; 427/126.5; 502/101

[58] Field of Search ..... 204/290 R, 290 F; 427/123, 126.5; 502/101

[56] References Cited

U.S. PATENT DOCUMENTS

| | | | |
|---|---|---|---|
| 3,878,083 | 4/1975 | DeNora | 204/290 F |
| 3,926,751 | 12/1975 | DeNora | 204/290 F |
| 4,425,217 | 1/1984 | Beer | 204/290 F |

FOREIGN PATENT DOCUMENTS 0046727 3/1982 European Pat. Off. .

*Primary Examiner*—John F. Niebling

*Attorney, Agent, or Firm*—Arthur S. Collins

[57] ABSTRACT

A method of making a catalytic lead-based oxygen-evolving anode comprises catalytically activating titanium sponge particles larger than 300 microns by impregnating with a solution containing Mn and Ru compounds, in amounts corresponding to Mn/Ru in an atomic ratio between 70/30 and 90/10, and thermally converting the compounds to an electrocatalyst comprising Mn and Ru in oxide form. Catalytic Ti sponge particles with up to 3 wt % Ru are thus produced, which are then uniformly distributed on the surface of a lead anode base in an amount greater than 400 g/m$^2$, pressed, and partly embedded, thereby firmly anchoring and electrically connecting them to the lead anode base. The catalytic lead-based anode thus produced operates with oxygen evolution on the catalytic particles at a reduced potential at which the lead base remains electrochemically inactive. It thereby operates with significant energy savings over an extended service life.

7 Claims, No Drawings

METHOD OF MAKING A CATALYTIC LEAD-BASED OXYGEN EVOLVING ANODE

This application is a continuation-in-part of copending application Ser. No. 467,158 filed Feb. 16, 1983; now abandoned.

FIELD OF THE INVENTION

The present invention relates to catalytic oxygen evolving anodes, and in particular to the manufacture of a catalytic lead-based oxygen evolving anode.

BACKGROUND OF THE INVENTION

The development of industrially acceptable catalytic anodes involves complex problems since the industrial performance of an anode depends on numerous intricately linked and interacting factors such as for example: the choice of anode materials, its manufacturing process and conditions, the industrial application and operating conditions of the anode.

While a multitude of patents reflect on one hand the great interest and considerable efforts to develop catalytic anodes, it is quite remarkable that only very few anode embodiments are on the other hand industrially applied on a large scale. This striking discrepancy between innumerable anodes proposed and the very few embodiments actually applied in practice is nevertheless not so surprising in light of the complex problems and interacting factors generally indicated above which make any attempt to develop an anode that fully meets the extremely severe technical and economic industrial requirements a particularly difficult and unpredictable undertaking.

Lead or lead alloy anodes have been widely used in processes for electrowinning metals from sulphate solutions. They nevertheless have important limitations, such as a high oxygen overvoltage and loss of the anode material leading to contamination of the electrolyte, as well as the metal product obtained on the cathode. Anodes of lead-silver alloy provide a certain decrease of the oxygen overvoltage and improvement of the current efficiency, but they still have the said limitations as a whole.

In order to ensure uniform electrodeposition of metal on the cathode, metal electrowwining cells are generally operated with a current density of a few hundred $A/m^2$ and consequently require a very large anode surface area, so that the anode cost with respect to the relatively low value of the metal electrowon per unit area is critical and must be kept sufficiently low to be economically justified for electrowinning.

It has been proposed to use dimensionally stable titanium anodes with a catalytic oxide coating for oxygen evolution. Such oxygen anodes are nevertheless subject to extremely severe oxidation attack and corrosion due to anodically evolved oxygen and exposure to highly corrosive electrolytes, which leads to anode passivation due to loss of the anode coating and oxidation of the titanium base. It has moreover been proposed to provide the titanium base of such anodes with a protective undercoating comprising a platinum group metal, before applying the outer catalytic coating. However, these coatings generally provide insufficient protection of the titanium base to justify the high cost of using such dimensionally stable titanium anodes comprising precious metals.

Dimensionally stable anodes with mixed oxide coatings comprising platinum group metals and valve metals are described in U.S. Pat. No. 3,632,498. An example of this patent relates to the preparation of a fine Ti-Pd mixed oxide powder which is then applied by rolling or hammering into a rod of soft-quality titanium. However, the amount of precious metal incorporated in the mixed oxide powder and applied to the electrode in this manner could be prohibitive for various industrial applications. Thus, when the electrode surface is to be substantially covered with the mixed oxide powder, and more particularly when the electrode is intended for operation at a relatively low current density such as is used in metal electrowinning, the cost of precious metal thus applied in the form of a mixed oxide may be especially prohibitive.

Ruthenium was for the first time successfully applied by H. Beer to produce dimensionally stable anodes with a mixed oxide coating which combines the high stability of rutile $TiO_2$ with the excellent electrocatalytic properties of $RuO_2$ for chlorine evolution, while raising the oxygen potential, and thereby enhancing the selectivity for producing chlorine as opposed to oxygen. These significant advantages and more particularly the high stability of such anodes explain their outstanding success in the chlorine industry throughout the world since more than 15 years.

On the other hand, such an anode with a $TiO_2$-$RuO_2$ mixed oxide coating hardly seems suitable for use as an oxygen evolving anode since it neither exhibits a sufficiently low oxygen potential, nor sufficiently protects the titanium base against oxygen evolution. Such an anode thus does not provide sufficient energy savings, nor an adequate service life to justify the anode costs for most applications of oxygen evolving anodes.

According to Example 8 of U.S. Pat. No. 4,052,271, an anode having a titanium core provided with a coating comprising iridium oxide and manganese oxide, is stated to have a chemical resistance far superior to that of a core coated with metallic iridium, and to be particularly suited for the preparation of per-compounds.

U.S. Pat. No. 4,289,591 relates to a method of electrolytically generating oxygen which comprises providing a catalytic cathode and a catalytic oxygen evolving anode respectively bonded to opposite surfaces of a solid polymer electrolyte ion transporting membrane, a catalyst being provided at the anode comprising ruthenium oxide and manganese oxide. Accordng to this patent, said catalyst is produced by a modified Adams method, wherein ruthenium and manganese salts are mixed, an excess of sodium nitrate is incorporated, the mixture is fused at 500° C. for three hours, and the residue is washed and dried to provide ruthenium oxide-manganese oxide powder, which is then bonded to said solid polymer electrolyte ion transport membrane. However, the described modified Adams method for producing a finely divided catalyst powder is not intended, nor seems particularly suitable for manufacturing a complete electrode structure.

Oxygen evolving anodes with a manganese oxide coating on a titanium core have likewise been proposed, but hardly provide a sufficient catalytic effect, significant energy saving, or an adequate long-term service life to justify their cost in industrial applications.

A catalytic lead-based oxygen evolving anode recently invented by H. Beer is described in his previous application Ser. No. 293,384 filed Aug. 17, 1981 (now U.S. Pat. No. 4,425,217), which is hereby incorporated by reference herein.

The catalytic lead-based anode according to said recent invention of H. Beer, essentially comprises catalytic particles of valve metal activated with a minor amount of platinum group metal, which are uniformly distributed on and partly embedded in the surface of an anode base of lead or lead alloy; said catalytic particles are thereby firmly anchored and electrically connected to said anode base, while their remaining non-embedded part projects from said surface of the anode base, thereby presenting a larger projecting surface than the underlying surface of the anode base of lead or lead alloy. Oxygen can thereby be catalytically evolved on said projecting surface of the partly embedded catalytic particles at a reduced potential at which the underlying lead or lead alloy remains electrochemically inactive and thereby essentially serves as a current-conducting support for said partly embedded catalytic particles.

Such a catalytic, lead-based oxygen evolving anode can provide various advantages, which may be summarized as follows:

(a) It can be operated at a significantly reduced oxygen potential, well below that of conventional anodes of lead or lead alloy currently used in industrial metal electrowinning, whereby the energy costs for electrowinning metals may be decreased accordingly.

(b) Contamination of the electrolyte and the cathodic deposit can be substantially avoided, since it has been established that the lead or lead alloy of the anode base is effectively protected from corrosion when oxygen is evolved on the catalytic particles at such reduced potentials.

(c) Dendrite formation on the cathode will lead to no serious deterioration of the performance of this anode, since it operates at a reduced potential, at which lead base which does not undergo notable corrosion.

(d) Conventional lead or lead alloy anodes may be readily converted into such a catalytic anode, so that industrial electrowinning cells may be retrofitted simply and inexpensively to provide improved performance.

(e) The reduced cell voltage obtained with such a catalytic anode can be readily monitored to rapidly detect any notable rise of the anode potential, so that spent catalytic particles may be readily replaced or rectivated.

(f) Ruthenium can be used very economically by applying it in minimal amounts (less than 6 wt%) to a many times larger amount of titanium sponge particles partly embedded in the anode base, so that the precious metal cost may be justified by the improvement in anode performance. Restricted amounts of ruthenium can thus be advantageously combined with less expensive materials.

(g) Decreased short-circuits could be observed in copper electrowinning plants equipped with such catalytic anodes, which would result in improved cathodic current efficiency, and thereby further increase the energy savings due to anode operation at a reduced oxygen potential.

The industrial development of said catalytic lead-based anode, more particularly as a catalytic oxygen anode suitable for metal electrowinning, has shown that ruthenium must be employed to catalytically activate the valve metal particles, since the use of other precious metals, which are far more expensive and much less available, could be prohibitive, and may be impractical.

Ruthenium is a relatively inexpensive precious metal which is capable of providing excellent catalytic activity for oxygen evolution, but it is on the other hand known that ruthenium by itself, in metallic form or as a simple oxide, lacks adequate stability under oxygen-evolving conditions, this being due to its tendency, at anode potentials above 1.43 V vs. NHE, to form $RuO_4$ which is highly volatile, and hence completely unstable.

It is nevertheless necessary to maintain high, long-term catalytic activity with a low oxygen potential for a sufficiently extended period to justify the costs of using such a catalytic anode by the total energy savings it provides during its useful service life.

In the course of said industrial development, it was moreover found in this connection that the main advantages underlying such a catalytic lead-based oxyben as described above could be achieved ore fully, while the useful anode service life could be considerably extended, if a relatively large amount of ruthenium (up to 20 $g/m^2$, or more) is applied to a correspondingly increased amount of titanium sponge particles (e.g. 700 to 800 $g/m^2$), partly embedded in the lead anode base.

However, for this purpose, the ruthenium had to be stabilized in a suitable manner, and this important technical problem underlies the present invention.

THE INVENTION

An object of the present invention is to provide an improved catalytic lead-based oxygen anode of the previously mentioned type comprising catalytic valve metal particles partly embedded in an anode base of lead or lead alloy, so as to more fully achieve its advantages.

The catalytic particles applied according to the invention advantageously consist of titanium sponge and may have a size lying in the range between 150 and 1250 microns, an preferably in the range of about 300–1000 microns.

A particular object of the invention is to provide an improved method of manufacturing a catalytic lead anode of said type, whereby to extend its long-term performance and industrial service life.

To achieve these objects, the present invention now provides a method of manufacturing a catalytic lead-based oxygen evolving anode as set forth in the claims.

This method produces a catalytic anode having a lead or lead alloy base studded and uniformly covered with partly embedded catalytic titanium sponge particles activated by means of ruthenium oxide which is combined with a larger molar amount of manganese oxide, and is thereby stabilized and effectively protected from rapid loss by oxidation during operation of the anode.

This improved electrocatalytic performance and stability of the Ru-Mn oxide system under the conditions of oxygen evolution in acid media constitutes a particularly advantageous feature of the catalytically activated titanium particles used on a lead base according to the present invention.

It has also been found that the formation of titanium oxide by thermal decomposition on the activated particles provides a further improvement of the stability of the particles.

It has moreover been established that a more efficient use of the ruthenium is achieved when larger activated particles are first pressed into the lead anode base and this is followed by pressing smaller particles, which may advantageously have a higher proportion of ruthenium than the larger particles. This 2-step pressing procedure has been found to improve the contact with the lead base is well as the long-term stability of the catalytically activated particles.

This invention thus essentially serves to provide a catalytic lead anode of said type with a ruthenium-based electrocatalyst having an improved resistance to oxidation, so as to effectively protect the lead base, hile providing a low oxygen potential and consequent energy savings over a considerably extended anode service life.

The significant stabilizing effect which is achieved by combining ruthenium oxide with a larger molar amount of manganese oxide according to the method of the present invention may be seen from the following examples and the comparative test data given below.

The following examples serve to illustrate different modes of carrying out the present invention.

EXAMPLE 1

An activating solution was prepared by dissolving 0.57 g $RuCl_3$.aq.(40%Ru) and 1.33 g $MN(NO_3)_2$.aq. in 4 ml 1-butyl-alcohol. The solution was then diluted with six times its weight of 1-butyl-alcohol.

3.25 g of Ti sponge (particle size greater than 630 microns) was degreased with trichlorethylene, dried and impregnated with the activating solution. After each impregnation, the titanium sponge was dried at 100° C. for about 1 hour. A heat treatment was then effected at 200° C. for 10 minutes and finally at 400° C. under an external air flow for about 10 minutes. This activation procedure was carried out 5 times. The Ru and Mn loadings thus obtained amounted to 28.4 mg Ru/g Ti and 36.0 mg Mn/g Ti.

The same activating solution was used also on 4.9 g Ti sponge (particle size 315–630 microns). The drying and heating temperatures, as well as the number of impregnations were identical to those applied to the larger particles. However, the duration of the heat treatment at 400° C. was 12 minutes. The Ru and Mn loadings of the particles mounted in this case to 27 mg Ru/g Ti sponge and 34 mg Mn/g Ti sponge.

The activated, catalytic titanium sponge particles thus obtained were then uniformly distributed and pressed onto a lead sheet coupon. The larger catalytic particles (size greater than 630 microns) were pressed first at 290 kg/cm$^2$, so that the Ti, Mn and Ru loadings per unit lead-sheet area amounted respectively to 322, 11.5 and 9.1 g/m$^2$. The smaller activated titanium particles (315–630 microns) were then pressed at 360 kg/cm$^2$ the Ti, Mn and Ru loadings being in this case respectively 400, 13.7 and 10.8 g/m$^2$.

An electrode sample (L62) was thus obtained with a lead base uniformly covered with Ru-Mn oxide ($30RuO_2$-$70MnO_2$) activated titanium sponge particles in an amount corresponding to 722 g/m$^2$ Ti sponge, 19.9 g/m$^2$ Ru and 25.2 g/m$^2$ Mn.

This electrode sample was tested as an oxygen evolving anode in $H_2SO_4$ (150 gpl). The electrode potential (oxygen half-cell potential) at a current density of 500 A/m$^2$ amounted to 1.57 V vs.NHE after 68 days, 1.59 V after 194 days, and 1.75 V after 210 days of anodic operation.

For comparison, another anode sample (L61), which was obtained by directly pressing smaller particles of activated Ti sponge on lead, with higher Ru and Mn loadings corresponding to 27.9 and 35.4 g/m$^2$ respectively, exhibited an anode potential of 1.62 V after 69 days of operation under identical conditions, and a potential of 1.63 V when anode operation was stopped after 194 days.

A further anode sample (L76) was prepared like L62 but the larger particles were only activated 4 times instead of 5. The overall Ru and Mn loadings amounted in this case to 22.1 and 28.0 g/m$^2$ respectively. The anode was tested under identical conditions and showed a potential of 1.5 V vs.NHE after 22 days and 1.8 V after 140 days of operation.

EXAMPLE 2

Ti sponge (particle size 315–630 microns) was activated like in Example 1, and was then pressed onto lead at 270 kg/cm$^2$ to give a loading of Ti, Mn and Ru corresponding to 427, 15.1 and 11.9 g/m$^2$ respectively. Finally particulate $ZrO_2$ (particle size 150–500 microns) was pressed with a pressure of about 410 kg/cm2 on top of the Ti sponge to give a $ZrO_2$ loading corresponding to 248 g/m$^2$.

The electrode sample thus obtained (L82) was tested as an oxygen evolving anode in $H_2SO_4$(150 gpl). The electrode potential at a current density of 500 A/m$^2$, amounted to 1.50 V vs NHE after 150 h of anodic operation, to 1.59 V after 293 days, and 1.65 V after 470 days. This corresponds to a voltage saving of 410 mV and 350 mV with respect to pure, untreated lead.

EXAMPLE 3

Ti sponge (particle size 315–630 microns) was activated first with a Ru and Mn containing solution as described in Example 1, the activating procedure also being identical to the one described in Example 1.

Following this activation, a top-coating was applied by impregnation with a solution containing Ti-butoxide which was prepared by diluting 1.78 g Ti-butoxide in 3.75 ml l-butyl-alcohol and 0.25 ml HCl. The impregnated sponge was dried at 100° C. for about 1 h. A heat treatment was then effected at 250° C. for 12 minutes and finally at 400° C. under an external air flow for about 12 minutes.

The resulting activated titanium particles were then pressed onto a lead sheet at about 250 kg/cm$^2$. An electrode sample (L84) was thus obtained with a lead base uniformly covered with Ru-Mn oxide ($30RuO_2$-$70MnO_2$) activated titanium sponge particles "topcoated" with Ti-oxide providing loadings of 13.3 g Ru/m$^2$, 16.9 g Mn/m$^2$ and 515 g Ti sponge/m$^2$, plus 5.8 g "topcoated" Ti/m$^2$.

This electrode sample was tested as an oxygen evolving anode in $H_2SO_4$ (150 gpl). Its potential at a current density of 500 A/m$^2$ amounted to 1.49 V vs NHE after 130 h of anodic operation. This corresponds to a 510 mV saving over untreated lead. The anode potential amounted to 1.64 V after 128 days, which corresponds to a 360 mV saving over untreated lead.

EXAMPLE 4

An activating solution was prepared as described in Example 1, but it was diluted with only three times its amount of l-butyl-alcohol.

4.11 g of Ti sponge (particle size 400–630 microns), was impregnated with the activating solution. After each impregnation, the titanium sponge was dried at 100° C. for about 1 hour. A heat treatment was then effected at 250° C. for about 10 minutes and finally at 400° C. under an external air flow for about 10 minutes. This activation procedure was carried out 3 times. The Ru and Mn loadings thus obtained amounted to 36.2 mg Ru/g Ti and 45.8 mg Mn/g Ti.

The activation procedure, described in Example 1 for the Ti sponge with a particle size larger than 630 microns, was applied also in this case for the larger particles (greater than 630 microns). However, the activation was carried out only 4 times. The Ru and Mn loadings thus obtained amounted to 23.5 mg Ru/g Ti and 29.9 mg Mn/g Ti.

The activated titanium sponge particles were then uniformly distributed, pressed and partly embedded at the surface of a lead sheet coupon. The larger particles (size greater than 630 microns) were pressed first at 240 kg/cm$^2$ to give Ti, Mn and Ru loadings per unit lead sheet area of 350, 10.5 and 8.3 g/m$^2$ respectively. An electrode sample (L95) was thus obtained with a lead base uniformly covered with Ru-Mn oxide activated titanium sponge particles in an amount corresponding to 760 g/m$^2$ Ti sponge, 23.2 g/m$^2$ Ru and 29.3 g/m$^2$ Mn. This electrode sample was tested as an oxygen evolving anode in $H_2SO_4$ (150 gpl). The electrode potential at a current density of 500 A/m$^2$ amounted to 1.65 V vs NHE after 287 days of anodic operation.

For comparison, another anode sample (L93), which was obtained by directly pressing smaller particles of activated Ti sponge at 280 kg/cm$^2$ on lead, with Ru and Mn loadings corresponding to 15.4 and 19.5 g/m$^2$ respectively, was tested under identical conditions. The electrode potential, after 289 days, was 1.78 V vs NHE.

A further anode sample (L92) was prepared like L95 but the smaller particles (400–630 microns) were activated like in Example 1 (L62). The overall Ti, Mn and Ru loadings amounted in this case to 726, 22.5 and 17.7 g/m$^2$ respectively. Pressing of the larger particles and smaller particles was carried out at 290 kg/cm$^2$ and 410 kg/cm$^2$ respectively. The anode has been tested under identical conditions and showed a potential of 1.78 v vs NHE after 289 days of operation.

EXAMPLE 5

An activating solution was prepared as described in Example 4.

4,22 g of larger particles (particle size above 630 microns) was activated twice under the conditions specified in Example 4 to give 21.5 mg Ru/g Ti and 27.4 mg Mn/g Ti.

Another activating solution was applied to Ti sponge with a smaller particle size ranging from 400–630 microns. This activation solution corresponds to the one described in Example 4 with the difference that it was diluted with only twice its amount of l-butyl-alcohol. Two activations were carried out in accordance with Example 4. The Ru and Mn loadings per gram Ti amounted to 25.9 and 32.9 mg/g respectively.

An anode sample (L 120) was prepared by pressing the larger particles first at 210 kg/cm2 to give Ti, Mn and Ru loadings of 360, 9.8 and 7.7 g/m$^2$ respectively. Smaller activated titanium particles (400–630 microns) were then pressed at 320 kg/cm$^2$ to give Ti, Mn and Ru loadings of 420, 13.9 and 10.9 g/m$^2$ respectively. The overall Ti, Mn and Ru loadings thus obtained amounted to 780, 23.7 and 18.6 g/m$^2$ respectively.

The electrode sample was tested as an oxygen evolving anode in $H_2SO_4$ (150 gpl). The electrodes potential at a current density of 500 A/m$^2$ amounted to 1.58 V vs NHE after 218 days and to 1.65 V vs NHE after 275 days of anodic operation.

EXAMPLE 6

Two activating solutions were prepared with a higher Mn/Ru ratio than described in Example 1.

Solution A: 0.537 g $RuCl_3$.aq and 2.0819 g Mn $(NO_3)_2$.aq in 3.75 ml l-butyl-alcohol Solution B: 0.537 g $RuCl_3$.aq and 4.6844 g $Mn(NO_3)_2$.aq in 3.75 ml n-butyl-alcohol.

Both solutions A and B were diluted with 3 times their amount of n-butyl-alcohol. Solution A corresponds to a molar ratio of $MnO_2/RuO_2=4$ and solution B corresponds to a molar ratio of $MnO_2/RuO_2=9$.

4.27 g of Ti sponge (particle size 315–630 microns) was impregnated with diluted solution A. After each impregnation, the titanium sponge was dried at 100° C. for about 1 h. A heat treatment was then effected at 250° C. for 14 minutes and finally at 400° C. under an external air flow for about 14 minutes. This activation procedure was carried out 3 times. The Ru and Mn loadings of the catalytic particles thus obtained amounted to 29.3 mg Ru/g Ti and 63.8 mg Mn/g Ti.

4.16 g of Ti sponge (particle size 315–630 microns) was impregnated with diluted solution B. The activation was carried out in the same manner as with activating solution A. The Ru and Mn loadings thus obtained amounted to 19.9 mg Ru/g Ti and 97.4 mg Mn/g Ti.

The activated Ti sponge particles were then pressed onto a lead sheet coupon. The larger particles (greater than 630 microns), activated as in Example 5, were pressed first at 230 kg/cm$^2$ to give Ti, Mn and Ru loadings per unit lead-sheet area of 449, 12.0 and 9.4 g/m$^2$ respectively.

Subsequently smaller activated (with diluted solution A) Ti particles (315–630 microns) were pressed at 350 kg/cm$^2$ to give Ti, Mn and Ru loadings of 399, 25.5 and 11.7 g/m$^2$ respectively.

An electrode sample (L 164) was thus obtained with a lead base uniformly covered with Ru-Mn oxide activated titanium sponge particles in an amount corresponding to 848 g/m$^2$ Ti sponge, 21.1 g/m$^2$ Ru and 37.5 g/m$^2$ Mn.

This electrode sample was tested as an oxygen evolving anode in 150 gpl $H_2SO_4$. Its potential at a current density of 500 A/m$^2$ amounted to 1.50 V vs NHE after 36 days of anodic operation.

For comparison, another anode sample (L 161), was obtained by directly pressing smaller particles of activated Ti sponge (with diluted solution A) at 320 kg/cm$^2$ on lead, with Ti, Ru and Mn loadings corresponding to 531, 15.6 and 34.0 g/m$^2$ respectively.

This electrode L 161 has been tested under identical conditions and showed a potential of 1.60 V vs NHE after 70 days of operation.

In another set of experiments, Ti sponge particles larger than 630 microns, activated as in Example 5, were pressed first at 230 kg/cm2 to give Ti, Mn and Ru loadings per unit lead-sheet area of 428, 11.5 and 9.0 g/m$^2$ respectively. Smaller activated titanium sponge particles (size 315–630 microns), obtained with solution B, were then pressed at 350 kg/cm$^2$ to give Ti, Mn and Ru loadings of 493, 48.0 and 9.8 g/m$^2$ respectively. An electrode sample (L 163) was thus obtained with a lead base uniformly covered with Ru-Mn oxide activated titanium sponge particles in an amount corresponding to 921 g/m$^2$ Ti, 59.5 g/m$^2$ Mn, and 18.8 g/m$^2$ Ru. This electrode was tested as an oxygen evolving anode in 150 gpl $H_2SO_4$ at 500 A/m$^2$. Its potential after 33 days of operation amounted to 1.57 V vs NHE.

EXAMPLE 7

Lead anodes comprising catalytic titanium sponge particles partly embedded in a lead sheet base (18×14×0.5 cm) and activated by means of a 30 Ru/70 Mn oxide catalyst were prepared in the following manner.

An activating solution (Srm8) was prepared with the following composition by weight: 3.2% $RuCl_3$ aq.(40% Ru); 7.3% $Mn(NO_3)_2.4H_2O$; 89.5% l-butanol.

740 grams of this activating solution were added slowly to 1 kg. of titanium sponge powder, (which had been sieved to a particle size between 400 and 600 microns) while continuously stirring in a mixer.

The Ti sponge powder, thus impregnated with the activating solution, was then carefully dried in air in an oven at 150° C. for 24 hours. The dried Ti sponge was next heated to 300° C. for 30 minutes, then at 400° C. for 30 minutes, and finally cooled slowly in the oven to ambient temperature.

The described activating process comprising impregnation, drying, and heat treatment was repeated once more to obtain the activated Ti sponge powder carrying the applied ruthenium-manganese oxide catalyst. The amounts of Ru and Mn thus applied correspond to 1.9% Ru and 2.4% Mn by weight of Ti sponge.

The catalytically activated Ti titanium sponge particles thus produced were uniformly distributed on and pressed into the lead sheet base by applying a pressure of 500 kg/m$^2$ and heating to 280° C. for about 10 seconds, so that the catalytic particles were partly embedded and thereby firmly anchored in the lead sheet base. The amounts of Ti sponge, Ru, and Mn thus applied to both sides of the lead base corresponded to loadings of 840 Ti sponge/m$^2$, 16 g Ru/m$^2$, and 20 g Mn/m$^2$ of the lead substrate surface. The catalytic lead anodes (MK2) thus produced with 16 g Ru/m$^2$ on the lead sheet base were operated as an oxygen evolving anode at a current density of 400 A/m$^2$ in an electrolytic pilot cell containing a circulating sulphate electrolyte for zinc electrowinning and an aluminum cathode spaced 20 mm from the anode.

Such anodes operated at 400 A/m$^2$ for about one year with a mean potential of about 1.6 V vs. NHE and a mean zinc yield well above 80%. These anodes were periodically cleaned to remove manganese oxide electrodeposited on the anode during operation.

EXAMPLE 8

Lead anodes (B68) comprising catalytic titanium sponge particles partly embedded on a lead base and catalytically activated by means of a 30Ru-70Mn oxide catalyst, were manufactured in the following manner.

A homogeneous activating solution was prepared by dissolving ruthenium chloride and manganese nitrate in ethanol in the following concentrations by weight: 6 wt% $RuCl_3$ aq (40% Ru); 15 wt% $Mn(NO_3)_2.4H_2O$; 79 wt% ethanol.

50 grams of titanium sponge powder having a particle size in the range from 500 to 750 microns, were degreased by pretreatment with trichlorethylene, dried and impregnated twice with this activating solution. After each impregnation, the impregnated Ti sponge was dried at 120° C. under vacuum (15 mm Hg) for 45 minutes, heated in an air stream at 200° C. for 30 minutes, after which the temperature was raised to 400° C. for 20 minutes. After repeating once more this activation by impregnation, drying and heat treatment as described, the titanium sponge powder was finally subjected to a post-heat treatment at 400° C. for 60 minutes in an air stream. The Ru and Mn amounts thus applied as a Ru-Mn oxide catalyst to the titanium sponge corresponded respectively to 2.5% Ru and 3.2% Mn by weight of Ti.

The catalytically activated titanium sponge particles thus produced were uniformly distributed on and pressed into the surface of a lead sheet coupon (80×20×2 mm), so that these catalytic sponge particles were partly embedded and thereby anchored in the lead sheet base. The amounts of Ti sponge, Ru and Mn thus applied to both sides of the lead sheet corresponded respectively to loadings of 800 g Ti sponge/m$^2$, 20 g Ru/m$^2$ and 25 g Mn/m$^2$ of the lead substrate surface.

A first anode (B68-I) was produced in this manner, by pressing the catalytic particles with a pressure of 210 kg/m$^2$ and heating at 250° C. for 10 seconds. This first anode was tested as an oxygen evolving anode operating at 500 A/m$^2$ in aqueous sulphuric acid solution (150 gpl $H_2SO_4$), operated after 500 hours at 500 A/m$^2$ with an oxygen potential of 1.55 V vs.NHE, and operated after 10 months at 1.74 V vs. NHE.

A second anode (B68-II) was produced in the same manner, but by pressing at room temperature and applying a higher pressure of 450 kg/m$^2$ for 10 seconds. This second anode was tested as described above and operated at 500 A/m$^2$ with an oxygen potential vs. NHE of 1.50 V after 21 days, and is operating at 1.63 V after 10 months.

A third anode (B68-III) was produced in the same manner as this second anode (B68-II) but by applying catalytic sponge at smaller loadings corresponding to 400 g Ti/m$^2$, 10 g Ru/m$^2$, and 12.5 g Mn/m$^2$. This third anode (B68-III) was tested as described above and operated at 500 A/m$^2$, with an oxygen potential vs. NHE of 1.51 V after 21 days, and is operating at 1.77 V after 11 months.

A fourth anode (B68-IV) was produced in the same manner as (B68-III) but by applying catalytic sponge at even smaller loadings corresponding respectively to 200 g Ti/m$^2$, 5 g Ru/m$^2$ and 6.2 g Mn/m$^2$. This fourth anode (B68-IV) was tested as described above and was operating at 500 A/m$^2$ with an oxygen potential vs.NHE of 1.58 V after 21 days, which rose to 2.20 V after 120 days, thus indicating failure of the anode due to loss of its catalytic activity after 4 months.

EXAMPLE 9

Lead anodes comprising catalytic titanium sponge particles partly embedded in a lead base and activated by means of a 14Ru-86Mn oxide catalyst, were manufactured in the following manner.

An activating solution (Srm12) was prepared by dissolving ruthenium chloride and manganese nitrate in l-butanol with the following concentrations by weight: 8.3 wt% $RuCl_3$ aq.(40% Ru);48.1 wt% $Mn(NO_3)_2.4H_2O$; 43.6 wt% l-butanol.

50 grams of titanium sponge powder having a particle size in the range from 400 to 630 microns, was impregnated with this activating solution (diluted with three times its weight of n-butanol) in an amount corresponding to 0.5% Ru by weight of Ti. After this impregnation, the Ti sponge was dried at 120° C. for 3 hours after which the temperature was raised to 400° C. for 20 minutes. A second activation was carried out using a solution having the above composition, diluted with two times its weight of n-butanol, in an amount sufficient to apply an additional 2.0% Ru by weight of titanium. The drying and heat treatment steps were repeated as described above. The total amounts of Ru and Mn thus applied as a Ru-Mn oxide catalyst to the titanium sponge corresponded respectively to 2.5% Ru and 8.2% Mn by weight of Ti.

The catalytically activated titanium sponge particles thus produced were uniformly distributed on and pressed into the surface of a lead sheet coupon (80×20×2 mm), so that these catalytic sponge particles were partly embedded and thereby anchored in the lead sheet base. The amounts of Ti sponge, Ru and Mn thus applied to both sides of the lead sheet, per unit area of the lead substrate surface, corresponding to loadings of 800 g Ti sponge/$m^2$, 20 g Ru/$m^2$ and 65.4 g Mn/$m^2$.

A first anode (L269) was produced in this manner, by pressing the catalytic particles with a pressure of 450 kg/$cm^2$. This first anode was tested as an oxygen-evolving anode operating at 500 A/$m^2$ in aqueous sulphuric acid solution (150 gpl $H_2SO_4$) and was operating after 300 hours at 500 A/$m^2$ with an oxygen potential of 1.56 V vs. NHE, and 1.65 V after 180 days.

A second anode was produced in the same manner, except that the titanium sconge was impregnated first with the amount of solution corresponding to 2.0 wt% of Ru by weight of titanium and then with the amount corresponding to 0.5 wt% Ru by weight of titanium. This second anode (L270) was tested as described above and was operating after 300 hours at 500 A/$m^2$ with an oxygen potential of 1.59 V vs. NHE, and 1.67 V after 180 days.

EXAMPLE 10

A reference electrode sample (B14) was prepared, for comparison, from catalytic particles activated with ruthenium oxide and partly embedded in a lead sheet.

An activating solution (S24) was prepared for this purpose by dissolving 0.537 g $RuCl_3$.aq.(40% Ru) and 0.25 ml HCl in 3.75 ml l-butanol.

6 grams of titanium sponge (particle size 315–630 microns) was degreased with trichlorethylene, dried, and impregnated with said activating solution, followed by drying in air at 140° C. for 15 minutes, heating at 300° C. in an air flow for 15 minutes, repeating this sequence once more, and finally heat treating at 420° C. in an air flow for 15 minutes. This activating procedure was repeated once more, so that the 6 grams of titanium sponge was activated twice with a total amount of about 3 grams of said activating solution.

The catalytic Ti sponge particles thus obtained by activation with ruthenium oxide were then uniformly distributed and pressed onto a lead sheet coupon (Pb-0.06%Ca, 7×2×0.2 cm) by applying a pressure of 250 kg/$cm^2$ so that the Ti and Ru loadings per unit lead-sheet area corresponded to 700 g Ti sponge/$m^2$ and 20 g Ru/$m^2$.

The reference electrode sample (B14) thus obtained (a lead base uniformly covered with partly embedded, catalytic Ti sponge particles activated with ruthenium oxide), was tested as an oxygen evolving anode in $H_2SO_4$ (150 gpl) at 500 A/$m^2$. The electrode potential (oxygen half-cell potential) vs. NHE, amounted to 1.58 V after 60 days and 1.66 after 120 days, and then rose steeply to 2.1 V after 130 days of operation at an anode current density of 500 A/$m^2$, indicating failure of the anode due to loss of its catalytic activity.

This reference anode (B14) contains no manganese oxide in combination with ruthenium oxide, but was prepared and tested under similar conditions, and is mainly intended for comparison with anodes according to the invention as described above.

It may thus be seen that this reference anode sample (B14) activated with ruthenium oxide, corresponding to a catalyst loading of 20 g/$m^2$ Ru applied to Ti sponge with a loading of 700 g/$m^2$ Ti, failed at about 4 months at 500 A/$m^2$.

On the other hand, samples B68-I, II, and III activated with Ru-Mn oxide (30Ru-70Mn) according to Example 8 above exhibit much more stable catalytic performance with time in service as oxygen evolving anodes, performing satisfactorily even after 10 or 11 months of continuous operation, which is several times as long as the total lifetime of said reference anode (B14).

The following is a summary of the test data from Example 8 and 10:

| Anode Sample | B-68-I | B68-II | B68-III | B68-IV | B14 |
|---|---|---|---|---|---|
| Loading (g/$m^2$) | | | | | |
| Ti | 800 | 800 | 400 | 200 | 700 |
| Ru | 20 | 20 | 10 | 5 | 20 |
| Mn | 25 | 25 | 12.5 | 6.2 | 0 |
| Potential (V vs. NHE) | 1.74 | 1.63 | 1.77 | 2.2 | 2.1 |
| after__ Days | 300 | 300 | 330 | 120 | 130 |

As may be seen from the various examples above, an anode according to the invention can be fabricated in a simple manner and be used for prolonged evolution of oxygen at a potential which is significantly lower than the anode potential corresponding to oxygen evolution on lead or lead alloy under otherwise similar operating conditions.

It may be noted, that no loss of lead from the base could be observed when testing anode samples according to the invention as described in the above examples, whereas a notable lead loss could be observed in the electrolyte when testing lead or lead alloy reference samples under the same conditions.

It has moreover been found that simultaneously applying heat and pressure, when partly embedding the valve metal particles in the lead or lead alloy at the surface of the anode base, can facilitate their fixation while preventing the particles from being completely embedded in and/or flattened on the base.

It may also be noted that further improvements may well be expected with respect to the above examples by optimizing conditions for providing anodes according to the invention to give, stable electrochemical performance with maximum economy of precious metal utilization.

It is understood that the catalytic particles may be applied and anchored to the lead or lead alloy base of the anode, not only by means of a press as in the examples described above, but also by any other means such as pressure rollers for example, which may be suitable for providing the essential advantages of the invention.

The invention provides various advantages of which the following may be mentioned for example:

(a) The anode according to the invention can be operated at a significantly reduced potential, well below that of conventional anodes of lead or lead alloy currently used in industrial cells for electrowinning metals from acid solutions. The cell voltage and hence the energy costs for electrowinning metals may thus be decreased accordingly.

(b) Contamination of the electrolyte and the cathodic deposit by materials coming from the anode can be substantially avoided, since it has been experimentally established that oxygen is evolved on the catalytic particles at a reduced potential, at which the lead or lead alloy of the anode base is effectively protected from corrosion.

(c) Dendrite formation on the cathode which may lead to short-circuits with the anode and can thereby burn holes into the anode, will nevertheless lead to no serious deterioration of the performance of the anode according to the invention, since it operates with oxygen evolution on the catalytic particles at a reduced potential, at which any part of the lead or lead base which is exposed does not undergo notable corrosion.

(d) Conventional lead or lead alloy anodes may be readily converted into improved anodes according to the invention and it thus becomes possible to retrofit industrial cells for electrowinning metals in a particularly simple and inexpensive manner to provide improved performance.

(e) The reduced cell voltage obtained with anodes according to the invention can be readily monitored so as to be able to rapidly detect any notable rise which may occur in the anode potential. The catalytic particles on the lead or lead alloy base may thus be readily reactivated or replaced whenever this should become necessary.

(f) Ruthenium can be used as catalyst in an extremely economical manner, by combining it in a very small proportion with titanium sponge particles applied in a many times larger amount to the anode base of lead or lead alloy. The cost of ruthenium can thus be justified by the resulting improvement in anode performance.

(g) Ruthenium can thus be used in very restricted amounts and combined with less expensive materials.

(h) Decreased short-circuits could be observed in copper electrowinning plants equipped with anodes according to the invention. This resulted in an improved cathodic current efficiency, thereby further increasing the energy savings already achieved by the reduced cell voltage due to operation of the anode for the invention at a reduced oxygen half-cell potential.

INDUSTRIAL APPLICABILITY

Anodes according to the invention may be advantageously applied instead of currently used anodes of lead or lead alloy, in order to reduce the energy costs required for industrially electrowinning metals such as zinc, copper, cobalt, and nickel and to improve the purity of the metal produced on the cathode.

Such anodes may be usefully applied to various processes where oxygen evolution at a reduced overvoltage is required.

We claim:

1. A method of making a catalytic lead-based, oxygen evolving anode comprising catalytic titanium particles activated with a minor amount of a ruthenium-based electrocatalyst, which particles are uniformly distributed on and partly embedded in the surface of an anode base of lead or lead alloy, whereby they are electrically connected to said base and present a large exposed active surface projecting from said base for evolving oxygen at a reduced potential at which the underlying lead or lead alloy at the surface of the anode base remains electrochemically inactive, comprising the steps of:

(a) producing said catalytic titanium particles by impregnating titanium sponge particles having a size greater than 300 microns with an activating solution containing thermally decomposable manganese and ruthenium compounds in proportions corresponding to molar ratios of Mn/Ru of between about 7/3 and about 9/1, then drying and heat treating said particles to convert said compounds into oxides of ruthenium and manganese and repeating this impregnating, drying and heat treating sequence at least once to provide an effective concentration of ruthenium amounting to less than 6% by weight of the titanium sponge particles;

(b) applying to the surface of said anode base a uniform distribution of said catalytic titanium sponge particles in an amount corresponding to at least 400 grams of titanium sponge per square meter of said surface; and (c) pressing said particles against said surface until they are partially embedded therein and firmly anchored to said anode base in good electrical contact therewith.

2. The method of claim 1, characterized in that such catalytic titanium particles larger than 600 microns are first pressed into the surface of the anode base and smaller such catalytic titanium particles are then pressed into said anode base surface.

3. The method of claim 2, characterized in that said smaller particles are provided with a greater concentration of ruthenium than said large particles.

4. The method of claim 2 characterized in that said smaller particles are smaller than 600 microns but not under about 300 microns in size.

5. The method of claim 1, characterized in that titanium oxide is further formed on said catalytic particles by thermal decomposition of a titanium compound applied after converting the ruthenium and manganese compound to oxide form on said particles.

6. The method of claim 1 wherein the concentration of ruthenium is not more than about 3% by weight of the titanium sponge particles.

7. A catalytic anode obtained by the method of claim 1.

* * * * *